US011944859B2

(12) United States Patent
Lu et al.

(10) Patent No.: US 11,944,859 B2
(45) Date of Patent: Apr. 2, 2024

(54) HULA HOOP

(71) Applicants: Xiaoqiang Lu, Jinhua Zhejiang (CN); Shuge Lu, Jinhua Zhejiang (CN); Jine Zhou, Jinhua Zhejiang (CN)

(72) Inventors: Xiaoqiang Lu, Jinhua Zhejiang (CN); Shuge Lu, Jinhua Zhejiang (CN); Jine Zhou, Jinhua Zhejiang (CN)

(73) Assignee: JINHUA GAODENG SPORTING GOODS CO., LTD, Jinhua Zhejiang (CN)

( * ) Notice: Subject to any disclaimer, the term of this patent is extended or adjusted under 35 U.S.C. 154(b) by 566 days.

(21) Appl. No.: 17/151,157

(22) Filed: Jan. 16, 2021

(65) Prior Publication Data

US 2021/0252323 A1 Aug. 19, 2021

(30) Foreign Application Priority Data

Feb. 17, 2020 (CN) ..... 202010094945.X
Sep. 28, 2020 (CN) ..... 202011042893.8

(51) Int. Cl.

| | |
|---|---|
| ***A63H 33/02*** | (2006.01) |
| ***A63B 19/00*** | (2006.01) |
| ***A63B 19/02*** | (2006.01) |
| ***A63B 21/00*** | (2006.01) |
| ***A63B 21/065*** | (2006.01) |

(52) U.S. Cl.

CPC ..... *A63B 19/02* (2013.01); *A63B 19/00* (2013.01); *A63B 21/065* (2013.01); *A63B 21/151* (2013.01); *A63H 33/02* (2013.01)

(58) Field of Classification Search

CPC ..... A63B 19/00; A63H 33/02
See application file for complete search history.

(56) References Cited

U.S. PATENT DOCUMENTS

| | | | | |
|---|---|---|---|---|
| 2,036,524 | A * | 4/1936 | Girard et al. | A63B 19/00 482/20 |
| 3,837,116 | A * | 9/1974 | Sun | A63H 33/02 446/450 |
| 3,892,084 | A * | 7/1975 | Hanysz | A63H 33/02 446/411 |
| 4,380,885 | A * | 4/1983 | Komagata | A63H 33/065 446/236 |

(Continued)

*Primary Examiner* — John A Ricci

(57) ABSTRACT

A hula hoop, comprising a hoop body which includes a plurality of unit sections connected end to end, two adjacent unit sections are detachably connected to each other through a connecting member, and each unit section has an accommodating groove for inserting the connecting member. The front section and the rear section of the connecting member are inserted into the accommodating grooves of two adjacent unit sections, and the unit section has a locking mechanism for keeping the connecting member in the accommodating groove. The hoop body comprises a plurality of unit sections connected end to end. Two adjacent unit sections are connected to each other through a connecting member, which can realize the rapid disassembly and assembly of the unit sections. By increasing or reducing the number of unit sections, the inner diameter of the hoop body can be changed to adapt to exercisers with different body shapes, and the hoop body can be opened at any position, which is more convenient to operate than the prior art.

10 Claims, 4 Drawing Sheets

(56) References Cited

U.S. PATENT DOCUMENTS

| | | | | |
|---|---|---|---|---|
| 5,338,244 | A * | 8/1994 | Huang | A63B 19/00 446/236 |
| 5,569,134 | A * | 10/1996 | Nordanger | A63B 19/00 446/236 |
| 6,102,769 | A | 8/2000 | Huang | |
| 6,309,273 | B1 | 10/2001 | Kim | |
| 6,814,645 | B2 | 11/2004 | Kuk | |
| 8,033,891 | B2 * | 10/2011 | Mendel | A63B 19/00 446/236 |
| 2009/0017719 | A1 * | 1/2009 | Lin | A63B 19/00 446/236 |
| 2015/0273260 | A1 * | 10/2015 | Hotchkis | A63B 19/00 482/23 |

* cited by examiner

HULA HOOP

FIELD OF THE INVENTION

The invention relates to a hula hoop

BACKGROUND OF THE INVENTION

Hula hoops are widely used as waist fitness equipment. Due to the large diameter of traditional hula hoops, it is easy to fall for unskilled people, thus discontinuing the exercise. To solve the above problem, the Chinese patent document CN204996071 U discloses a waist fitness device comprising a plurality of arc-shaped unit parts, which can be connected to form a hoop, and the inner diameter of the hoop is determined according to the number of unit parts. Each unit part has a pair of pivots at one end of the channel and a pair of pivot holes at the other end. Each unit part is pivoted in the pivot holes of the adjacent unit part through its pivots, and its overall length can be changed according to the number of connected unit parts, so as to be used by users with different body shapes. In addition, each unit part has a simple assembly structure to achieve the effect of quick assembly or disassembly. The unit parts are connected by the pivots. Although the unit parts can be quickly disassembled and assembled, the inner diameter of the formed hoop cannot be elastically changed and needs to be adjusted properly to adapt to the waist of the exercisers; at the same time, the minimum adjustment is determined by the length of the unit part, so that accurate adjustment cannot be achieved.

BRIEF SUMMARY OF THE INVENTION

The purpose of this invention is to provide a hula hoop that can be freely disassembled and assembled to adjust the inner diameter in view of the disadvantages of the prior art.

The purpose of this invention is achieved through the following technical solution:

A hula hoop, comprising a hoop body, characterized in that: the hoop body comprises a plurality of unit sections connected end to end, two adjacent unit sections are detachably connected to each other through a connecting member, and each unit section has an accommodating groove for inserting the connecting member. The front section and the rear section of the connecting member are inserted into the accommodating grooves of two adjacent unit sections, and the unit section has a locking mechanism for keeping the connecting member in the accommodating groove.

A first two protruding strips protruding outward and extending along the length direction are formed on both sides of the said connecting member, and a second two protruding strips protruding inward and extending along the length direction are formed on the two opposite groove walls of the said accommodating groove. The second protruding strips press on the upper side of the first protruding strips, and the first protruding strips and the second protruding strips cooperate to guide the said connecting member to be inserted into the accommodating groove and restrict the said connecting member from laterally coming out of the accommodating groove.

The said unit section has an arc structure, and the said accommodating groove is provided on the outer surface of the unit section and extends along the length direction of the said unit section.

The said connecting member has a plate-like structure, and reinforcing ribs protruding downward and extending along the periphery are formed at the bottom edge of the said connecting member.

The said connecting member is made of elastically deformable material.

A reinforced deformable structure located between two said adjacent unit sections is formed between the front section and the rear section of the said connecting member.

The said connecting member is arranged so that there is a gap between two adjacent unit sections.

The said locking mechanism includes an operating button and a spring. The operating button can be floatably provided on the said unit section between the locking position and the releasing position. The spring is arranged between the operating button and the said unit section to drive the operating button to reset to the locking position, the operating button has a first limiting portion, the said connecting member has a second limiting portion, an inclined guiding slope is formed on the front side of the first limiting portion, and inclined guiding slope is formed on the front side of the first limiting portion, and the second limiting portion can be guided by the guiding slope to the rear side of the first limiting portion.

This invention also includes a slider and a counterweight assembly. The slider is slidably arranged on the hoop body, and the counterweight assembly is connected to the slider. Both sides of the said unit section have track grooves extending along the length direction and passing through both side surfaces of the said unit section, the said slider has two side plates extending to both sides of the said unit section, and the side plates have rollers located in the track grooves.

A counter and a magnetic sensor are arranged on the said slider, a magnet that can be sensed by the magnetic sensor is arranged on a certain unit section, the magnetic sensor is connected to the counter, and the counter can obtain and display the number of moving revolutions according to the detection signal of the magnetic sensor.

This invention has the following beneficial effects:

The hoop body comprises a plurality of unit sections connected end to end. Two adjacent unit sections are connected to each other through a connecting member, which can realize the rapid disassembly and assembly of the unit sections. By increasing or reducing the number of unit sections, the inner diameter of the hoop body can be changed to adapt to exercisers with different body shapes, and the hoop body can be opened at any position, which is more convenient to operate than the prior art.

The connecting member is made of elastically deformable material as a deformable component, which can make a plurality of connected unit sections bend to form a circular hoop body, and can be deformed to form hoop bodies with different inner diameters, and the inner diameter of the hoop body has a certain elastic change to tighten the waist. The front and rear portions of the connecting member are inserted into the accommodating grooves of two adjacent unit sections and locked. That is, the connecting member is almost completely integrated into the unit sections, and only a small portion of the connecting member is used to isolate two adjacent unit sections, which can increase the reliability of the connection and reduce the stability of the formed loop body. The connecting member is arranged so that there is a gap between two adjacent unit sections, thereby increasing the relative elastic bending of two adjacent unit sections.

The accommodating groove is formed on the outer side surface of the unit section, that is, the connecting member is arranged on the outer peripheral surface of the loop body, so that the gap between the outer sides of two adjacent unit sections is supported by the connecting member, and the gap between the inner sides of two adjacent unit sections is cleverly supported by the waist of the human body, so as to prevent the unit sections from colliding and abrading between the inner sides, and further increase the elastic change of the inner diameter of the loop body.

The first protruding strips and the second protruding strips cooperate to guide the connecting member to be inserted into the accommodating groove and restrict the connecting member from coming out of the accommodating groove, so that the connecting member can be inserted more smoothly and accurately, and the locking mechanism can reliably lock the connecting member.

The locking mechanism comprises an operating button and a spring. The operating button has a first limiting portion with a guiding slope. The second limiting portion of the connecting member can be guided to the rear side of the first limiting portion by the guiding slope. The automatic locking of the connecting member is realized by the automatic reset of the spring, which as the advantages of simple structure and convenient operation.

BRIEF DESCRIPTION OF THE SEVERAL VIEWS OF THE DRAWINGS

The accompanying drawings illustrate one ore more embodiments of the invention and, together with the written description, serve to explain the principles of the invention, and wherein.

DETAILED DESCRIPTION OF THE INVENTION

Figure 1:
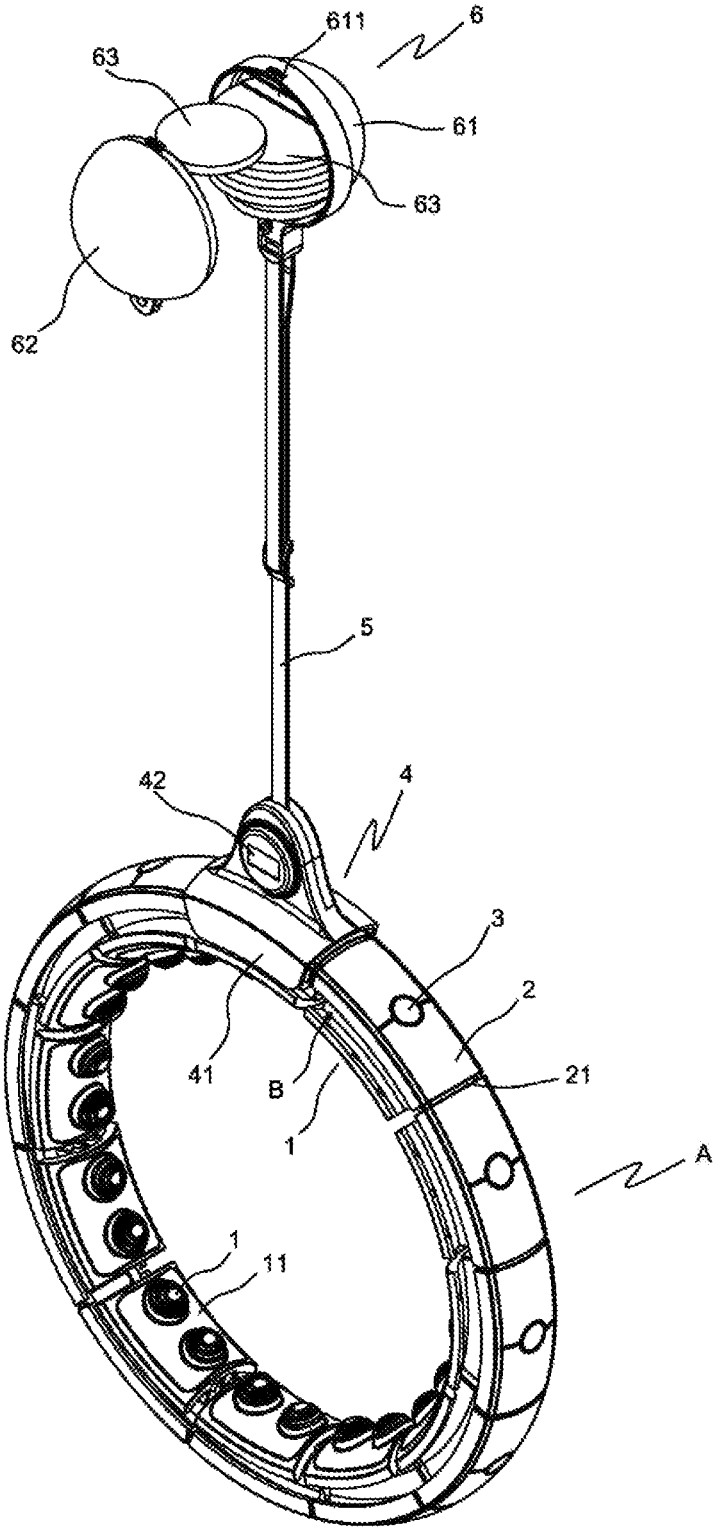
FIG. 1 is a perspective view of this invention.
Figure 2:
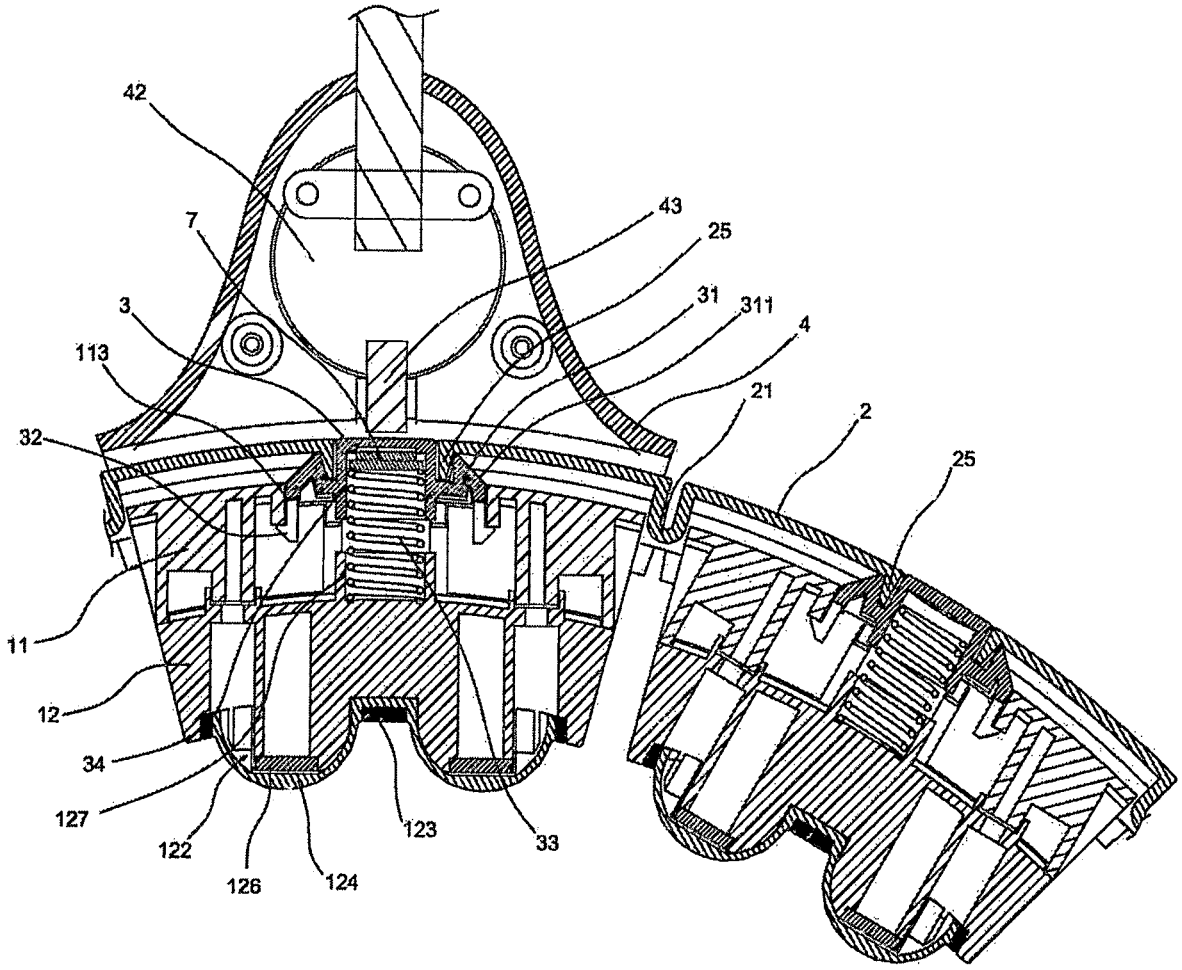
FIG. 2 is a partial cross-sectional view of this invention.
Figure 3:
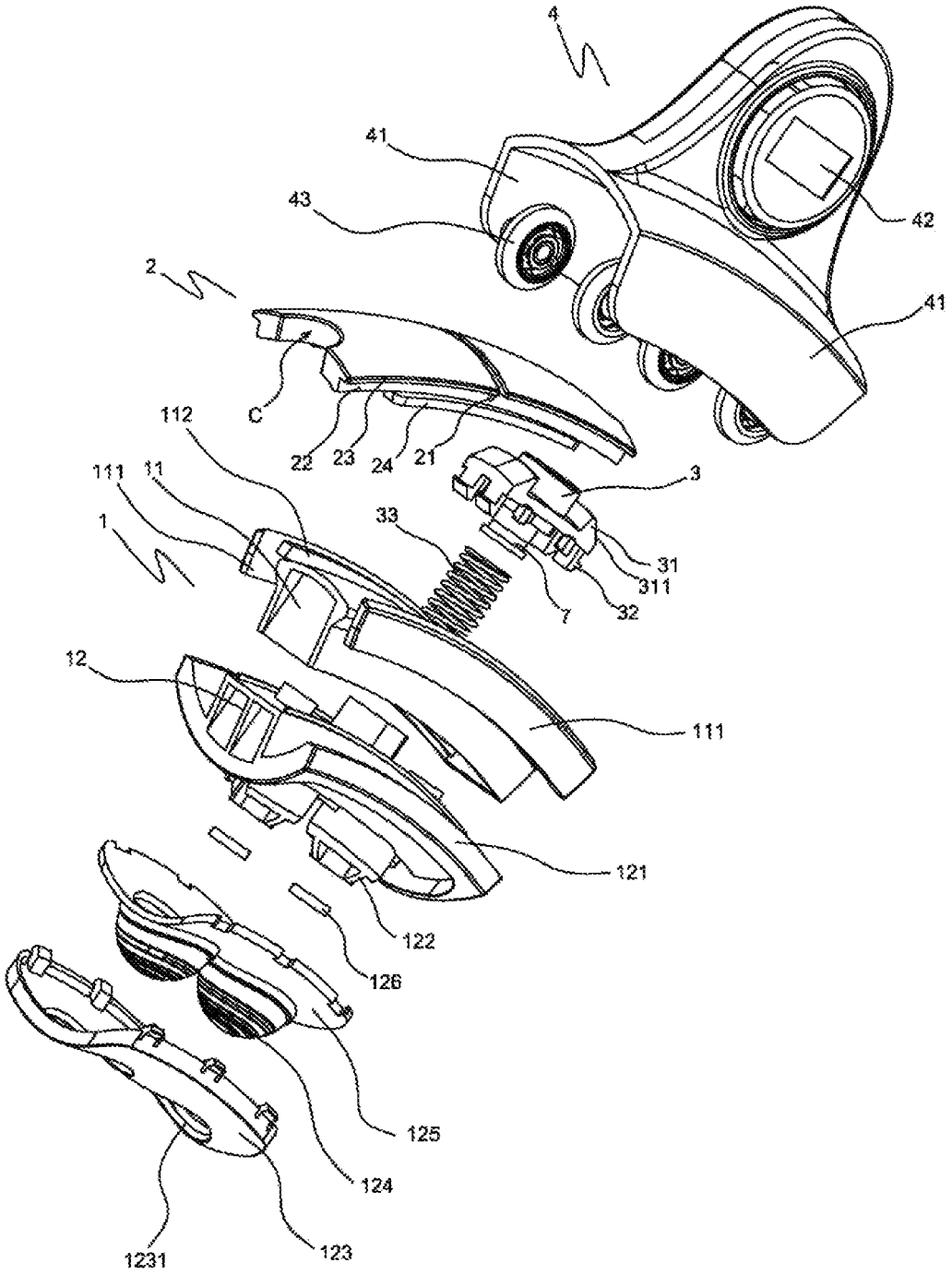
FIG. 3 is an exploded view of the unit section and the slider of this invention.
Figure 4:
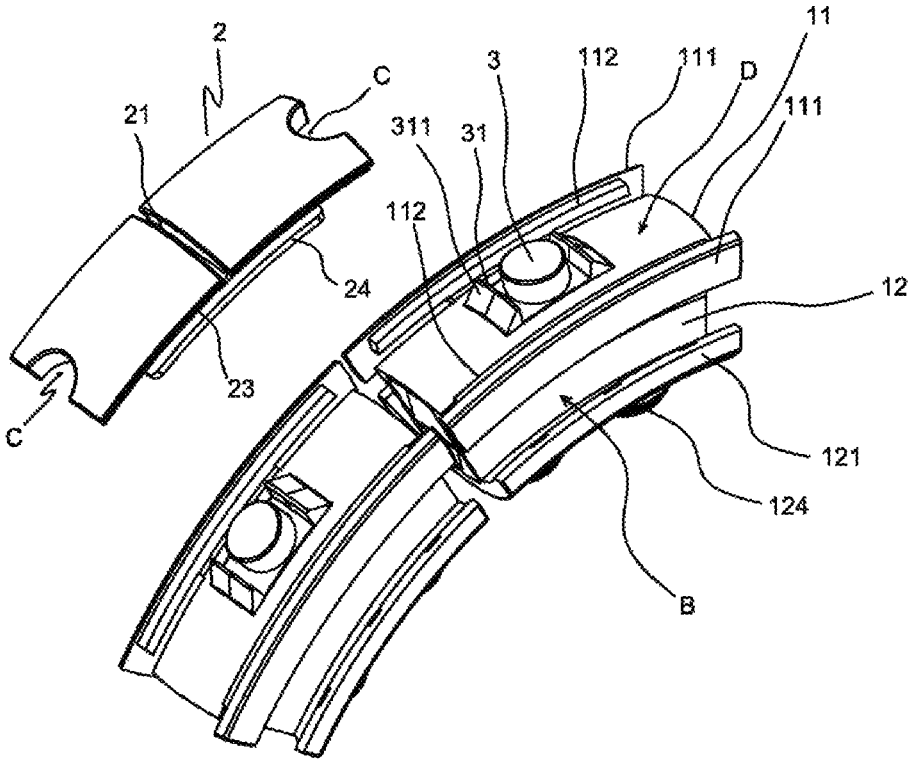
FIG. 4 is a schematic diagram of the connection of two adjacent unit sections; and, FIG. 5 is a perspective view of the connecting member.
Figure 5:
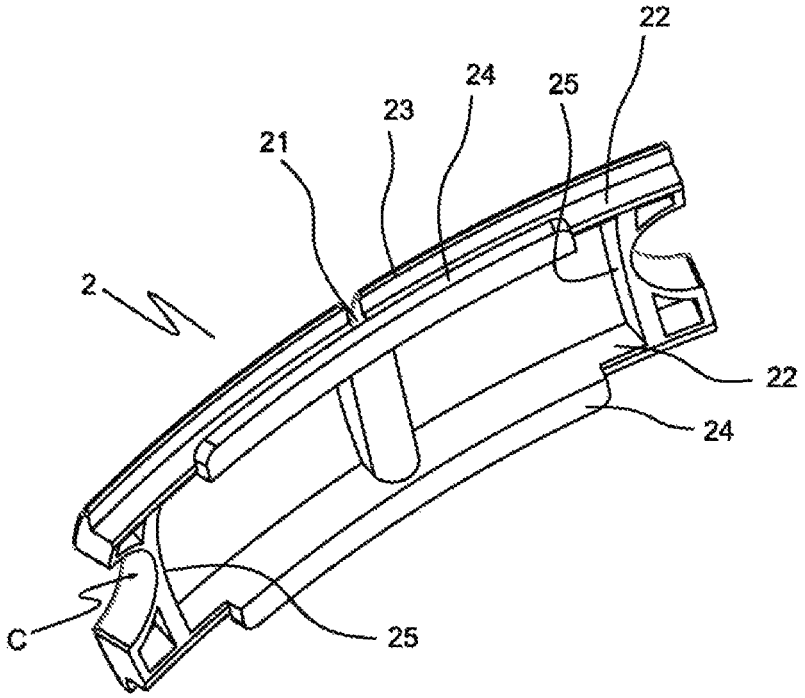

By reference to FIG. 1 to FIG. 5, a hula hoop is shown, which includes a hoop body A, a slider 4, and a counterweight assembly 6.

The hoop body A comprises a plurality of arc-shaped unit sections 1 connected end to end. Two adjacent unit sections 1 are detachably connected to each other through a connecting member 2. The connecting member 2 is an arc-shaped plate structure, and an accommodating groove D for inserting a portion of the connecting member 2 is formed on the unit section 1. The accommodating groove D is arranged on the outer side of the unit section 1 and extends along the length direction of the unit section 1. Specifically, the front portion of the concrete connecting member 2 is inserted into the accommodating groove D of the unit section 1, the rear portion of the connecting member 2 is inserted into the accommodating groove D of another unit section 1. The unit section 1 has a locking mechanism that keeps the connecting member 2 in the accommodating groove D, thereby connecting two adjacent unit sections 1 together, and the inner diameter of the hoop body A is changed by increasing or decreasing the number of the unit sections 1, so as to adapt to exercise with different body shapes.

A first two protruding strips 24 protruding outward and extending along the length direction are formed on both sides of the lower part of the connecting member 2. A reinforcing rib 22 protruding downward and extending along the periphery is formed at the bottom edge of the connecting member 2. The first two protruding strips 24 are arranged on the reinforcing rib 22. A second two protruding strips 112 protruding inward and extending along the length direction are formed on the two opposite groove walls of the accommodating groove D, the second protruding strips 112 press on the upper side of the first protruding strips 24, and the first protruding strips 24 and the second protruding strips 112 cooperate to guide the connecting member 2 to be inserted into the accommodating groove D and restrict the connecting member 2 from laterally coming out of the accommodating groove D. To cover the gap between the components, side edges 23 protruding outward are formed on both sides of the upper part of the connecting member 2.

The connecting member 2 is made of elastically deformable material, specifically plastic with a certain degree of elasticity. There is a gap between two adjacent unit sections 1, and a reinforced deformable structure 21 between the front and rear portions of the connecting member 2 is formed in the gap between two adjacent unit sections 1. The reinforced deformable structure 21 adopts a U-shaped groove structure, which makes two adjacent unit sections 1 bend relatively elastically after being connected to each other, so as to adapt to hoop bodies with different inner diameters. Of course, even without the reinforced deformable structure 21, as the connecting member 2 is made of elastically deformable material, the relative elastic bending of two connected adjacent unit sections 1 can still be realized. In addition, as the connecting member 2 has elasticity, the elastic change of the inner diameter of the hoop body A can be increased, and the reinforced deformation structure 21 can also increase the elastic change.

The specific structure of the unit section 1 includes an arc-shaped outer body 11 and an inner body 12, the outer body 11 is connected to the inner body 12 by screws, and two arc-shaped plates 111 extending along the length direction are formed on both sides of the outer body 11. A first arc-shaped groove is formed between the inner section of the arc-shaped plate 111 and the outer body 11, and the outer section of the two arc-shaped plates 111 forms an accommodating groove D for receiving the connecting member 2, the second protruding strips 112 are formed on the opposite surface of the outer section of the two arc-shaped plates 111, two side edges 121 extending upward are formed on both sides of the inner body 12, and a second arc-shaped groove is formed between the side edge 121 and the inner body 12. The first arc-shaped groove and the second arc-shaped groove are arranged oppositely to form a track groove B extending along the length direction of the unit section 1 and passing through both side surfaces of the unit section 1. The track groove B is a narrowing groove, and the slider 4 has two side plates 41 extending to both sides of the unit section 1. The side plate 41 has a plurality of rollers 43 located in the track groove B, so that the slider 4 can be slidably arranged on the hoop body A, and the counterweight assembly 6 is connected to the slider 4 through the strap 5. When the exerciser twists his/her waist, the slider 4 can be driven to slide and rotate on the hoop body A under the action of the counterweight assembly 6. The counterweight assembly 6 includes a spherical shell and a plurality of counterweights 63 arranged in the shell, and the shell includes a main body 61 and a detachable cover 62. The main body 61 has a groove 611 for placing the counterweights 63, and the exercise intensity can be changed by increasing or decreasing the number of counterweights 63.

The inner side of the unit section 1 has a massage part and a gusset plate 123. The massage part includes a base plate 125 and two massage protrusions 124 formed on the base plate 125. The massage part 124 is made of soft rubber, preferably a silicone material. A mounting groove for accommodating the base plate 125 and the gusset plate 123 is formed on the inner side surface of the inner body 12. A supporting portion 122 for supporting the massage protrusions 124 is formed in the mounting groove. A relief hole 1231 for massage protrusions 124 to pass through is formed on the gusset plate 123. The gusset plate 123 is snap-fitted with the mounting groove, and the base plate 125 is pressed into the mounting groove through the gusset plate 123 and the massage protrusions 124 are exposed. The massage protrusions 124 massage the waist of the exercisers, and a magnet 126 is additionally provided in the massage protrusions 124, so that the massage protrusions 124 have a magnetic therapy function.

The locking mechanism includes an operating button 3 and a spring 33. The operating button 3 can be floatably provided on the unit section 1 between the locking position and the releasing position. The specific structure is as follows: the middle of the outer surface of the outer body 11 has a mounting hole 113 for mounting the operating button 3, a first groove 34 for receiving one end of the spring 33 is formed at the bottom of the operating button 3, a second groove 127 for receiving the other end of the spring 33 is formed on the inner body 12, and the spring 33 is arranged between the first groove 34 and the second groove 127 to drive the operating button 3 to reset to the locking position. A plurality of limit hooks 32 are provided on the operating button 3, and the limit hooks 32 are used to restrict the operating button 3 from coming out of the mounting hole 113 from the outside of the outer body 11, the first two limiting portions 31 are provided on opposite sides of the operating button 3, and the second limiting portions 25 are respectively provided at the bottoms of both ends of the connecting member 2, an inclined guiding slope 311 is formed on the front side of the first limiting portions 31, and the second limiting portions 25 can be guided to the rear side of the first limiting portions 31 by the guiding slope 311 when the connecting member 2 is inserted into the accommodating slot D. In this process, the first limiting portions 31 are firstly compressed by the second limiting portions 25 to make the operating button 3 move to the releasing position. When the second limiting portions 25 move to the rear side of the first limiting portions 31, the operating button 3 is reset to the locking position under the action of the spring 33, so that the connecting member 2 cannot come out of the accommodating groove D. When two adjacent unit sections 1 need to be detached, the exercisers only need to press the operating button 3 to move to the releasing position, and then pull out the connecting member 2.

An arc-shaped notch C matching the main body of the operating button 3 is formed at the two ends of the connecting member 2, so that the connecting member 2 services not only as a connecting part of the unit sections 1 to connect two adjacent unit sections 1, but also as a forming part of the outer peripheral surface of the hoop body to make the overall structure more reasonable and compact.

The slider 4 has a counter 42 and a magnetic sensor 43. A certain unit section 1 has a magnet 7 which can be sensed by the magnetic sensor 43. The magnetic sensor 43 is connected to the counter 42, and the counter 42 can obtain the number of moving revolutions and display it according to the detection signal of the magnetic sensor 43. Specifically, the magnet 7 can be arranged in the first groove 34 to facilitate its assembly without the need of providing an installation structure. When the slider 4 rotates around the hoop body once, the magnetic sensor 43 can sense the magnet once, thus accurately counting the number of moving revolutions and displaying it through the counter 42.

The specific exercise method is as follows: Before exercise, the inner diameter of the hoop body A can be adjusted according to the waistline of the exerciser. The inner diameter of the hoop body A can be adjusted by increasing or reducing the number of unit sections 1. The disassembly and assembly of the unit sections 1 is achieved through the combination of the locking mechanism and connecting member 2, which enable quick and convenient disassembly and assembly of the unit sections 1, and the hoop body A can be opened at any position. The rollers 43 of the slider 4 are installed into the track groove B from the end of the unit section 1 at the opening position of the hoop body A, then wrap around the waist of the exerciser and connect the two adjacent unit sections 1 at the opening position of the hoop body A to close the hoop body A. Then, the exerciser twists his/her waist to drive the counterweight assembly 6 to rotate around the waist, thereby driving the slider 4 to rotate around the hoop body A, and the number of revolutions is counted and displayed during the rotation of the slider 4.

The embodiments as described above are only preferred ones of this invention, which shall not limit the scope of implementation of this invention. That is to say, equivalent changes and modifications made according to the scope of the patent application of this invention and the contents of the specification shall still fall within the scope of the patent of this invention.

What is claimed is:

1. A hula hoop, comprising a hoop body, characterized in that the hoop body comprises a plurality of unit sections connected end to end, with two adjacent unit sections detachably connected to each other through a connecting member having a front section, a rear section and a bottom edge: each unit section has an outer side surface; each unit section has an accommodating groove for inserting the connecting member; the accommodating groove has two opposite groove walls; the front section and the rear section of the connecting member are inserted into the accommodating grooves of two adjacent unit sections, and the unit section has a locking mechanism for keeping the connecting member in the accommodating groove.

2. The hula hoop according to claim 1, characterized in that a first two protruding strips protruding outward and extending along the length direction are formed on both sides of the said connecting member, and a second two protruding strips protruding inward and extending along the length direction are formed on the two opposite groove walls of the said accommodating groove; the second protruding strips press on the upper side of the first protruding strips, and the first protruding strips and the second protruding strips cooperate to guide the said connecting member to be inserted into the accommodating groove and restrict the said connecting member from laterally coming out of the accommodating groove.

3. The hula hoop according to claim 1, characterized in that the said unit section has an arc structure, and the said accommodating groove is provided on the outer side surface of the unit section and extends along the length direction of the said unit section.

4. The hula hoop according to claim 1, characterized in that the said connecting member has reinforcing ribs protruding downward and extending along a periphery at the bottom edge of the said connecting member.

5. The hula hoop according to claim 1, characterized in the said connecting member is made of elastically deformable material.

6. The hula hoop according to claim 1, characterized in that a reinforced deformable structure located between two said adjacent unit sections is formed between the front section and the rear section of the said connecting member.

7. The hula hoop according to claim 1, characterized in that the said connecting member is arranged so that there is a gap between two adjacent unit section.

8. The hula hoop according to claim 1, characterized in that the said locking mechanism includes an operating button and a spring; the operating button can be floatably provided on the said unit section between the locking position and the releasing position; the spring is arranged between the operating button and the said unit section to drive the operating button to reset to the locking position, the operating button has a first limiting portion, the said connecting member has a second limiting portion, an inclined guiding slope is formed on the front side of the first limiting portion, and the second limiting portion can be guided by the guiding slope to the rear side of the first limiting portion.

9. The hula hoop according to claim 1, characterized in that the hoop body also includes a slider and a counterweight assembly; the slider is slidably arranged on the hoop body, and the counterweight assembly is connected to the slider; both sides of the said unit section have track grooves extending along the length direction and passing through both side surfaces of the said unit section, the said slider has two side plates extending to both sides of the said unit section, and the side plates have rollers located in the track grooves.

10. The hula hoop according to claim 9, characterized in that a counter and a magnetic sensor are arranged on the said slider, a magnet that can be sensed by the magnetic sensor is arranged on a certain unit section, the magnetic sensor is connected to the counter, and the counter can obtain and display the number of moving revolutions according to the detection signal of the magnetic sensor.

* * * * *